US005600906A

United States Patent [19]

Hamid

[11] Patent Number: 5,600,906

[45] Date of Patent: Feb. 11, 1997

[54] AUTOMATIC SUCTION TYPE TRANSFER OF LIMP MATERIAL ON CONVEYORS

[75] Inventor: Hadi M. N. Hamid, New Hartford, N.Y.

[73] Assignee: Jet Sew Technologies, Inc., Bowling Green, Ky.

[21] Appl. No.: 538,220

[22] Filed: Oct. 3, 1995

[51] Int. Cl.[6] ..... D06C 3/00; B65H 20/10

[52] U.S. Cl. ..... 38/143; 271/197; 198/689.1

[58] Field of Search ..... 38/1 R, 69, 70, 38/143; 414/13, 797, 797.2; 271/197, 276; 198/689.1

[56] References Cited

U.S. PATENT DOCUMENTS

| | | | |
|---|---|---|---|
| 2,680,615 | 6/1954 | Edgar . | |
| 3,202,302 | 8/1965 | Insolio . | |
| 3,476,241 | 11/1969 | Ungerer . | |
| 3,659,840 | 5/1972 | Ruck | 271/197 X |
| 3,672,313 | 6/1972 | Firestein et al. . | |
| 4,455,018 | 6/1984 | Colglazier et al. . | |
| 4,480,742 | 11/1984 | Muylle | 38/143 X |
| 4,620,826 | 11/1986 | Rubio et al. . | |
| 4,627,608 | 12/1986 | Harms . | |
| 4,729,181 | 3/1988 | Weir | 38/143 |
| 5,416,992 | 5/1995 | Ueda et al. | 38/143 |
| 5,515,627 | 5/1996 | McCabe | 38/143 |

*Primary Examiner*—Ismael Izaguirre

[57] ABSTRACT

A transfer mechanism for transferring a limp workpiece from a first conveyor traveling at a first speed to a second conveyor traveling at a second speed different from the first speed or running at the same speed, includes a sensor for initially sensing a leading edge of the workpiece and a controller for controlling inhibiting of the workpiece a predetermined time after detecting the leading edge of the workpiece. Further, the transfer mechanism includes a suction device for supplying air flow to create a pressure differential and transfer the sensed leading edge of the workpiece from the first conveyor to a transfer mechanism, with the transfer mechanism traveling at the second speed. The transfer mechanism thereafter conveys at least the leading edge of the limp workpiece to the second conveyer and clamps the leading edge of the limp workpiece between both the transfer mechanism and the second conveyor. Subsequent to the workpiece being clamped between both the transfer mechanism and the second conveyor, the transfer mechanism then terminates air flow from the suction device and applies necessary compressed air. This drops the workpiece between the first and second conveyor to remove unnecessary wrinkles therefrom. The workpiece is thereafter conveyed on the second conveyor.

71 Claims, 6 Drawing Sheets

AUTOMATIC SUCTION TYPE TRANSFER OF LIMP MATERIAL ON CONVEYORS

BACKGROUND OF THE INVENTION

1. Technical Field of the Invention

The present application is directed to an automatic suction type transfer apparatus and method for transferring workpieces of limp material. More specifically, the transfer apparatus of the present application provides for transfer of a workpiece of a limp material (also known as a limp workpiece) from one conveyer to another without losing its orientation. The transfer apparatus and method enables transfer of a limp workpiece between conveyors operating or conveying at different speeds. Further, the transfer apparatus transfers the limp workpiece from a first conveyor to a second conveyor by creating a pressure differential and eliminates wrinkles in at least a portion of the limp workpiece during the aforementioned transfer.

2. Description of Related Art

Known transfer apparatuses and methods enabled transfer of workpieces from one conveyor to another or enabled removal and stacking of workpieces previously traveling on a particular conveyor. The apparatus for conveying the workpiece on a type of transfer apparatus, or for removing workpieces from a conveyor included vacuum type apparatuses which used vacuum suction to contact the workpiece and to remove it from the conveyor.

Problems existed, however, when the workpiece was one of a limp material, also known as a limp workpiece. Such materials included fabrics for example. When transferring a fabric from one conveyor to another, wrinkles tended to develop. Therefore, separate processes were necessary subsequent to the transfer of the workpiece, to smooth out any wrinkles obtained during the transfer process. The vacuum suction devices, in particular, tended to create wrinkles when utilized in conjunction with a limp workpiece.

Further problems existed when attempting to transfer a workpiece from a first conveyor moving at a first speed to a second conveyor moving at a second speed, different from the first speed. Differences in speeds were further complicated when the transfer apparatus was operating or conveying at a speed different from the speed of the first and/or second conveyor.

The aforementioned problems of transferring a workpiece between two conveyors operating at different speeds, and transferring utilizing a transfer apparatus operating at a speed different from the first conveyor and/or the second conveyor, were further complicated when the workpiece is a limp workpiece. The difference in speeds tended to create wrinkles in the workpiece, which again had to be smoothed out subsequent to the transfer of the limp material or workpiece to the second conveyor.

SUMMARY OF THE INVENTION

A first object of the present application is to alleviate the aforementioned known problems involving transfer of a limp workpiece from a first conveyor to a second conveyor.

Another object of the present application is to alleviate the known problems involving transferring workpieces between conveyors of differing speeds.

A still further object of the present application is to alleviate the problem of the creation of wrinkles in a limp workpiece during the transfer process, prior to conveying the workpiece on a next conveyor.

A yet further object of the present application is to alleviate additional problems of transfer of limp materials of different sizes, shapes, and weights.

These and other objects of the present application are fulfilled by providing a method of transferring a limp workpiece from a first conveyor to a second conveyor, comprising the steps of:

(a) sensing a leading edge of the limp workpiece traveling on the first conveyor;

(b) creating a pressure differential to transfer the sensed leading edge of the limp workpiece from the first conveyor to a transfer mechanism;

(c) conveying, on the transfer mechanism, the leading edge of the limp workpiece to the second conveyor;

(d) terminating the pressure differential created in step (b), subsequent to step (c), to drop a middle portion of the limp workpiece excluding at least the leading edge, between the first and second conveyors to remove wrinkles from the limp workpiece; and (e) conveying the limp workpiece on the second conveyor.

These and other objects of the present application are further fulfilled by providing a method of transferring a limp workpiece from a first conveyor traveling at a first speed, to a second conveyor traveling at a second speed different from the first speed, comprising the steps of:

(a) sensing a leading edge of the limp workpiece traveling on the first conveyor at the first speed;

(b) creating a pressure differential to transfer the sensed leading edge of the limp workpiece from the first conveyor to a transfer mechanism, traveling at the second speed;

(c) conveying, on the transfer mechanism, at least the leading edge of the limp workpiece to the second conveyor;

(d) conveying at least the leading edge on, and clamping at least the leading edge between, both the transfer mechanism and the second conveyor, both traveling at the second speed; and (e) terminating the pressure differential created in step (b) subsequent to the conveying and clamping of step (d).

These and other objects of the present application are even further fulfilled by providing a transfer apparatus for transferring a limp workpiece from a first conveyor to a second conveyor, comprising:

first means for sensing a leading edge of the limp workpiece traveling on the first conveyor;

second means for creating a pressure differential to transfer the sensed leading edge of the limp workpiece from the first conveyor to the transfer apparatus;

third means for conveying the leading edge of the limp workpiece to the second conveyor, the second means terminating the created pressure differential subsequent to the third means conveying the leading edge to the second conveyor, to drop a middle portion of the limp workpiece excluding at least the leading edge, between the first and second conveyors to remove wrinkles from the limp workpiece, thereafter conveyed on the second conveyor.

These and other objects of the present application are still further fulfilled by providing a transfer apparatus for transferring a limp workpiece from a first conveyor traveling at a first speed, to a second conveyor traveling at a second speed different from the first speed, comprising:

first means for sensing a leading edge of the limp workpiece traveling on the first conveyor at the first speed;

second means for creating a pressure differential and transfer the sensed leading edge of the limp workpiece from the first conveyor to the transfer apparatus traveling at the second speed;

third means for conveying at least the leading edge of the limp workpiece to the second conveyor, and for clamping at least the leading edge between both the third means and the second conveyor, both traveling at the second speed, the second means terminating the created pressure differential subsequent to the conveying of at least the leading edge of the limp workpiece to the second conveyor and the clamping of at least the leading edge of the limp workpiece between the third means and the second conveyor.

These and other objects of the present application will become more readily apparent from the detailed description given hereinafter. However, it should be understood that the preferred embodiments of the invention are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
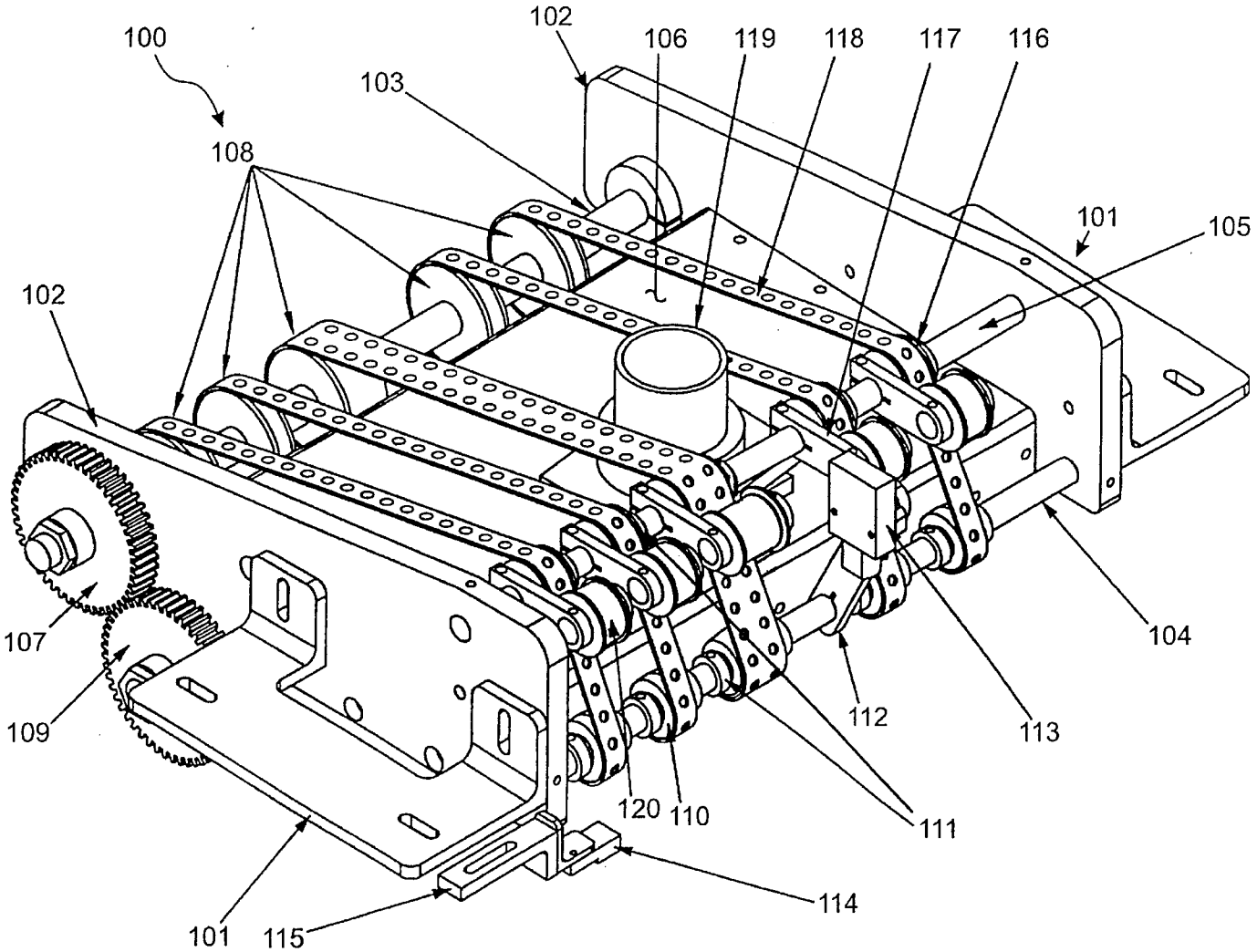
FIG. 1 is an isometric view of an automatic suction type transfer apparatus of the present application.

FIG. 1 illustrates an automatic suction type transfer mechanism 100 of a first preferred embodiment of the present application. The transfer mechanism 100 will be described with regard to the interconnected parts used therein as shown in FIG. 1; with regard to the apparatus in conjunction with two conveyors, and connection and mounting of the apparatus to the conveyors in FIG. 2; with regard to the control unit used in the transfer mechanism 100 as shown in FIG. 3; and with regard to the operation of transferring a limp workpiece between two conveyors as shown in FIGS. 4*a*–*h* and as discussed in FIG. 5.

The transfer mechanism 100 is shown in FIG. 1. The transfer mechanism 100 includes a mounting bracket 101 for mounting the transfer mechanism 100 on top of a conveyor. This is done, for example, by bolting down the mounting bracket 101 onto a frame of a conveyor. As shown in FIG. 1, two mounting brackets 101 exist, one on either side of the transfer mechanism 100. Side plates 102 are connected to each of the mounting brackets 101. These side plates 102 support each of the drive shaft 103, fixed shaft 104, idler shaft 105 and vacuum chamber 106 of the transfer mechanism 100. Each of the drive shaft 103, fixed shaft 104, idler shaft 105, and vacuum chamber 106 are connected between the two side plates 102.

The drive shaft 103 is supported by a bronze bushing on either end thereof and is free to rotate. The drive shaft 103 is further connected to a spur gear 107 mounted at one end, with the spur gear 107 being mounted outside of the side plate 102 as shown in FIG. 1. Further, between side plates 102 on the drive shaft 103 are knurled drive rollers 108. The outside diameter of each of these drive rollers 108 is preferably the same as the diameter of corresponding drive rollers on a second or post-conveyor 400, the conveyor which will receive the limp workpiece transferred from a first or pre-conveyor 300.

Figure 3:
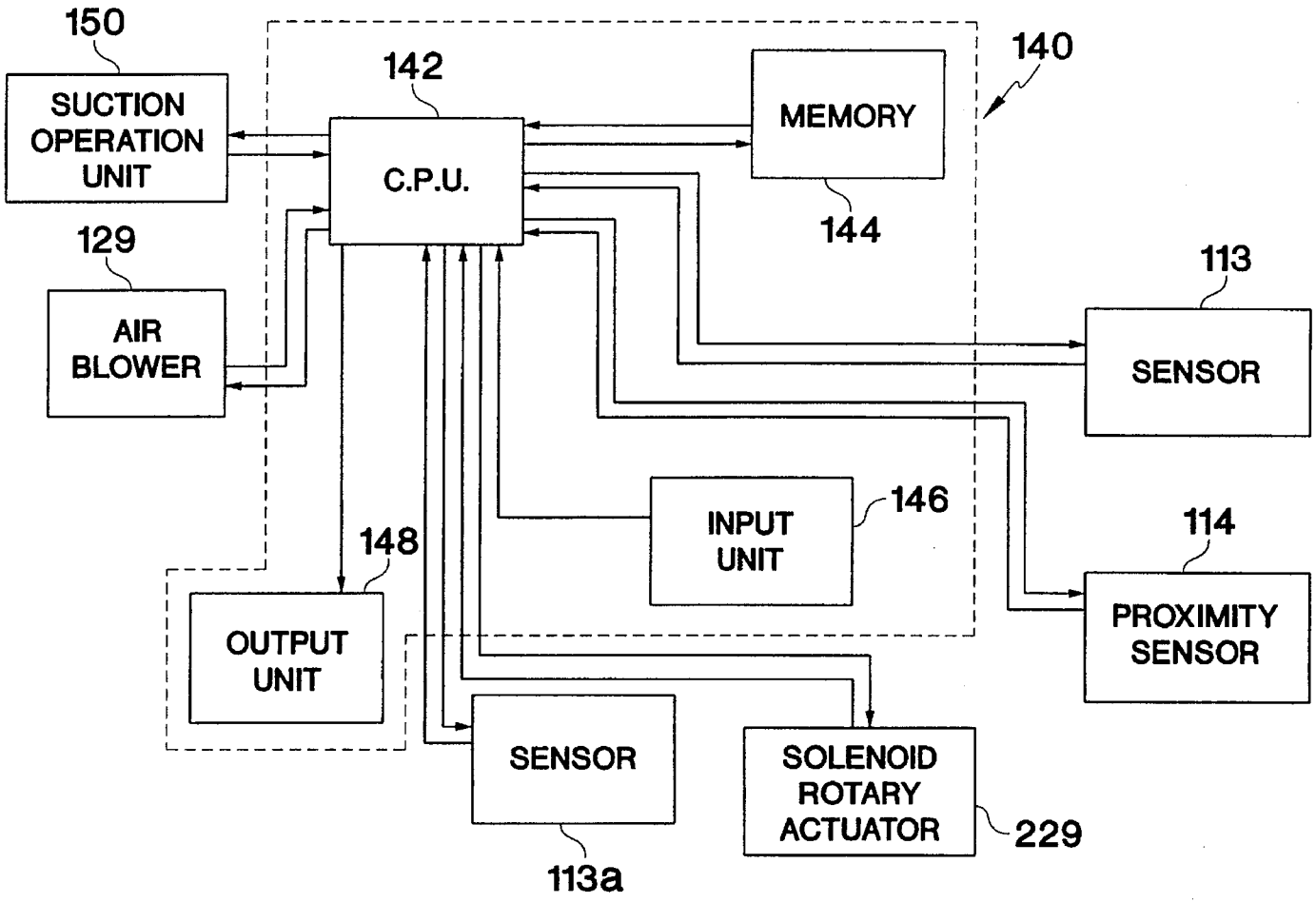
FIG. 3 is a block diagram illustrating the controller used in the automatic suction type transfer apparatus of the present application.

Connected to the drive shaft 430 for driving the drive rollers for the post-conveyor 400, as shown in FIG. 3, is a further spur gear 109 of the transfer mechanism 100, mounted at one end of drive shaft 430 and meshed with spur gear 107 as shown in FIG. 1. The spur gears 109 and 107 are then used to preferably operate the transfer mechanism 100 at the same traveling or conveying speed as that of the post-conveyor 400.

The transfer mechanism 100 further includes a fixed shaft 104. This fixed shaft 104 includes crowned rollers 110 which are free to rotate on the fixed shaft 104. The crowned rollers 110 are maintained in place using collars 111 on either side of each crowned roller 110. The drive shaft 103 preferably operates at the same speed as the drive shaft 430 of the post-conveyor 400, with the drive shaft 103 further including knurled drive rollers 108 which rotate with the rotation of the drive shaft 103, to subsequently rotate crowned rollers 110 through connecting belts 118 as will be described subsequently.

Further, as shown in FIG. 1, transfer mechanism 100 preferably includes a sensor mounting bracket 112, mounted on the fixed shaft 104. Mounted at another end of the sensor mounting bracket 112 is a photoelectric sensor 113. Operation and use of this photoelectric sensor 113 will be described hereafter.

Still further, it should be noted that transfer mechanism 100 also includes a proximity switch 114 mounted using coupling brackets 115. Operation and use of this proximity switch 114 will be described hereafter.

The idler shaft 105 as shown in FIG. 1 is also fixed and carries flanged rollers 116. These flanged rollers 116 are also free to rotate, and are maintained in place in a manner similar to crowned rollers 110, and are positioned using collars 111 on one side thereof and a tensioner bracket 117 on another side thereof. Flanged rollers 120, similar to rollers 116, are also mounted at the end of tensioner bracket 117 for producing tension in belts 118. These belts 118 are perforated (with holes therein) and travel around knurled drive rollers 108 of drive shaft 103, around flanged rollers 116 of idler shaft 105, between flanged rollers 116 of idler shaft 105 and flanged rollers 120 connected to tensioner brackets 117, and finally around crowned rollers 110 of fixed shaft 104. These belts provide a surface for transporting or conveying the limp workpiece from a first pre-conveyor 300 to a second post-conveyor 400. It should further be noted that each of the aforementioned crown rollers 110, flanged rollers 116 and 120, and knurled drive rollers 108 are spaced an equal predetermined distance apart such that belts 118 align with and correspond to belts 420 of the second post-conveyor 400. It should further be noted that the use of five belts in FIG. 1 is merely illustrative and should not be considered limitive of the present invention in any way.

Finally, FIG. 1 illustrates a suction device 119 for creating and terminating a pressure differential by activating/terminating air flow necessary in transferring a limp workpiece from a first pre-conveyor 300 to a second post-conveyor 400. The suction device 119 is preferably an air flow amplifier, such as a transvector manufactured by ITW Vortec for example, and is preferably mounted in the middle of the vacuum chamber 106 as shown in FIG. 1. It should be noted that the transvector as an air flow amplifier is merely exemplary, however, since there are many air flow amplifiers manufactured by other companies which could be used. Further, a vacuum generator can alternatively be used in place of an air flow amplifier since, as will be described hereafter, a vacuum generator can also create the necessary pressure differential by creating a negative pressure. However, based on cost considerations, an air flow amplifier as suction device 119 is preferred.

Thus, a pressure differential is created in the suction chamber 106 of suction device 119 to suck the limp workpiece 23. Initially, air flow is generated in one direction by the air flow amplifier (suction device 119), which in turn creates a pressure difference on top of the limp workpiece 23, thus lifting the limp workpiece 23. Accordingly, the slots in the bottom of the chamber 106 do not affect the process. If a vacuum device were used to create the pressure differential, instead of creating a pressure difference, a negative pressure (vacuum) would be created.

Yet another feature of the design of the transfer mechanism 100 of the present application is that the pressure difference created by the suction device 119 increases as the holes in the belts 118 get covered. Creation of a higher pressure difference allows for the lifting of bigger weights. Therefore when more holes are covered, more suction force is generated, which in turn lifts more weight.

More specifically, in the transfer process, when the portion of the leading edge of the limp workpiece 23 is lifted by suction device 119, the rest of the limp workpiece 23 remains on the first conveyer 300. As the limp workpiece 23 is transported by the transfer mechanism 100, the suction force of suction device 119 increases as a bigger portion of the limp workpiece 23 is lifted up. This is because, as a bigger portion of the limp workpiece 23 is lifted, more holes on the belt 118 are covered, thus increasing the suction force. Therefore, the process automatically adjusts itself to a requirement for increasing suction pressure by suction device 119.

Activation and termination of the pressure differential by creating and terminating air flow produced by the suction device 119 is controlled through a controller 140 (FIG. 3) of the transfer mechanism 100. This controller 140 is preferably a programmable logic controller (PLC) for controlling not only creation and termination of air flow in the suction device 119, but also for programming necessary delay times for creating a delay between inhibiting a portion of the conveyed workpiece as will be described hereinafter, and activation of the suction device 119 to create air flow and pressure differential. Further, the controller 140 can be used to receive detections by sensors 113, 113*a* and/or 114 of FIG. 3 to control activation or termination of the air flow amplifier (suction device 119). A further description of controller 140 will be provided hereafter in conjunction with a discussion of the operation of the transfer mechanism 100 of the present application.

Figure 2:
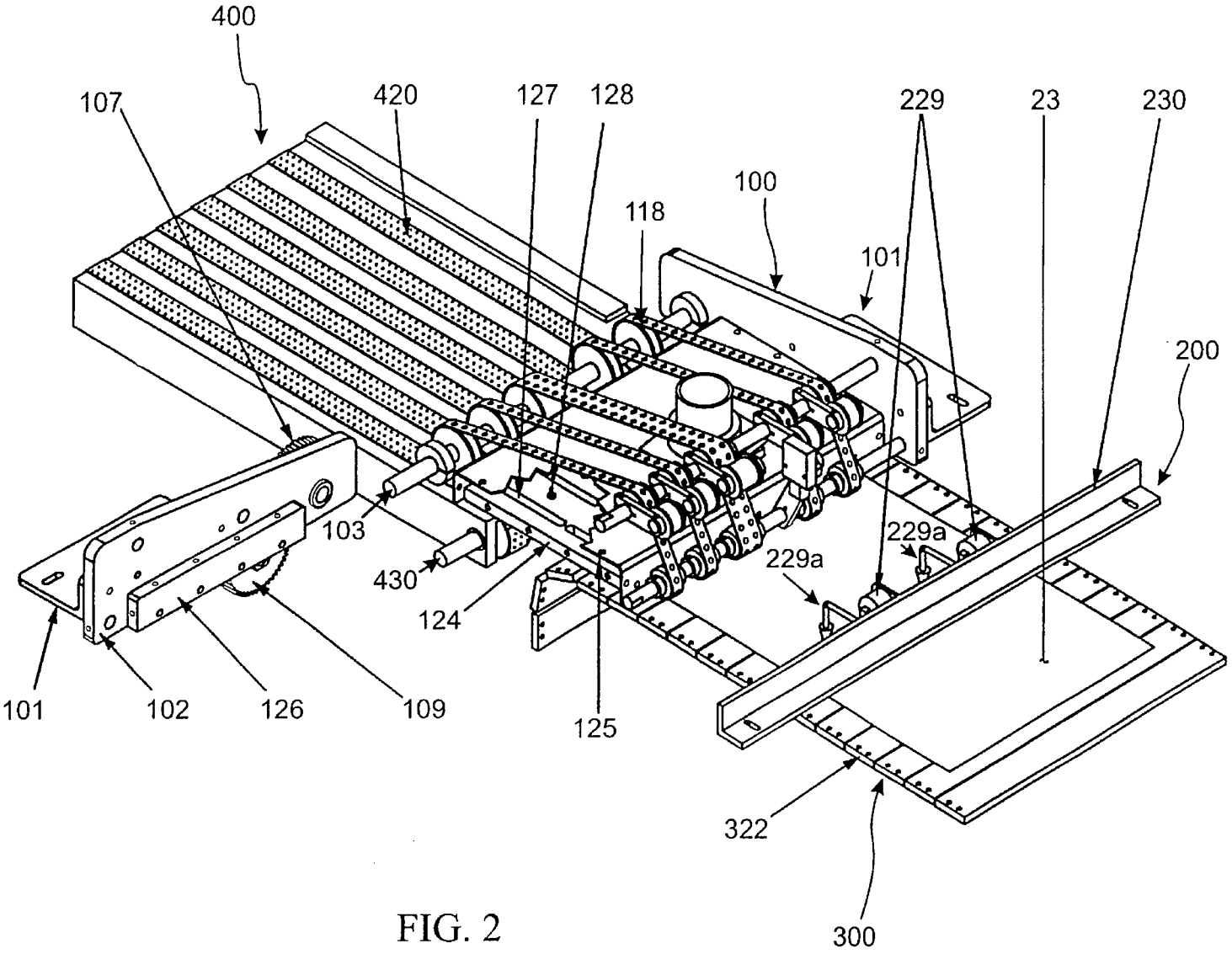
FIG. 2 is an isometric view illustrating the automatic suction type transfer apparatus with one of the side plates removed in order to illustrate internal construction in conjunction with a first conveyor and a second conveyor.

FIG. 2 illustrates the transfer mechanism 100 in relation to a first pre-conveyor 300 and the second post-conveyor 400. As shown in FIG. 2, one of the side plates 102 along with mounting bracket 101, spur gears 107 and 109 and side cover 126 (to be described hereinafter) have been removed to provide for illustration of the construction of suction chamber 106. Further, from the removed side plate 102, it should be clear how spur gear 107 connects to drive shaft 103, and more importantly how spur gear 109 connects to drive shaft 430 of the second post-conveyor 400 to thereby provide for operation of the transfer mechanism 100 at a conveying speed equal to the second post-conveyor 400.

FIG. 2 is further used to illustrate the belts 420 of the second post-conveyor 400 and their relation and correspondence to the belts 118 of the transfer mechanism 100.

With regard to the first pre-conveyor 300, FIG. 2 illustrates slats 322 thereof, for conveying a limp workpiece 23, this limp workpiece 23 being material of an undershirt for example. The pre-conveyor 300 includes groups of slats 322 which comprise a table. For example, the slats 322 can be one and one-half inches wide, and seventeen slats 322 can be used to make up a twenty-five inch table. In addition to including tables, pre-conveyor 300 further includes gaps (not shown), which are open areas (no slats 322) between tables. For example, one conveyor such as pre-conveyor 300 can include five gaps and five tables. It should be noted that the width of the slats, number of slats in a table, and number of tables and gaps in a conveyor have been given for illustrative purposes only and should not be considered limitive in any way.

Bracketed to the first pre-conveyor 300 is further shown an inhibiting device 200. This inhibiting device includes a mounting bracket 230 mounted to the first pre-conveyor 300 and two solenoid rotary actuators 229, each with fingers 229*a*. When the solenoid rotary actuators 229 are activated by CPU 142 of controller 140, the fingers 229*a* contact the limp workpiece 23, to inhibit conveying of at least a portion of the limp workpiece 23. Operation of the fingers 229*a* of the solenoid rotary actuators 229 to contact and inhibit conveying of the limp workpiece 23, and to uninhibit the limp workpiece 23 by removing contact therewith, will be discussed in conjunction with FIGS. 4 and 5.

With regard to the suction chamber 106, the suction chamber 106 includes a base plate 124, the base plate 124 including through-slots 127 cut therein for letting air flow from the top of the workpiece 23 to and through the air flow amplifier or suction device 119. The suction chamber 106 further includes a chamber cover 125 on the top of the suction chamber 106 and side covers 126 for covering the sides of the suction chamber 106.

FIG. 2 further illustrate air outlets 128 within the suction chamber 106 for outputting compressed air from an air blowing unit 129 (FIG. 3).

The base plate 124 of the suction chamber 106 further includes counter grooves cut from the bottom of the base plate 124 for the belts 118 to ride therein. Thus, the belts 118 are shown in FIGS. 1 and 2 on the top of the transfer mechanism 100, and ride in grooves cut in the bottom of base plate 124 on the bottom of the transfer mechanism 100 (not shown).

Finally, the chamber cover 125 of the suction chamber 106 include an opening therein for housing the suction device 119.

FIG. 3 illustrates the hardware necessary for controlling operation of the suction device 119, including activation and deactivation thereof to create and terminate a pressure differential; controlling the output of compressed air through the air outlets 128 of FIG. 2; receiving inputs from sensors 113, 113*a*, and/or 114 and executing control operations responsive thereto; controlling delays subsequent to sensing the limp workpiece 23 at certain predetermined locations on the conveyers; and for controlling operation of the solenoid rotary actuators 229 for fingers 229*a* thereof inhibiting and uninhibiting the limp workpiece 23 traveling on the first pre-conveyor 300.

FIG. 3 illustrates the controller 140 which includes central processing unit (CPU) 142 connected to a memory component 144, which preferably includes both random access memory (RAM) and erasable electronic programmable read only memory (EEPROM).

The controller 140 is preferably a PLC, preferably including an output unit 148 for displaying results, inputs, or instructions from the CPU 142, and an input unit 146 for preprogramming memory 144 or for inputting instructions to CPU 142 or sensors 113, 113*a*, or 114. For example, the input unit 146 can be used by a person monitoring transfer between a first pre-conveyor 300 and a second post-conveyor 400, wherein a time delay can be input based on a known speed of the first pre-conveyor 300; based upon a particular amount of the limp workpiece 23 passing beyond the inhibiting device 200; or based upon a known programmable delay. The CPU 142, connected to each of memory 144, input unit 146 and output unit 148, make up the programmable logic controller 140.

As previously stated, the controller 140, and more specifically the CPU 142 of the controller 140, controls activation and terminating air flow of the pressure difference created by the activating and terminating air flow of the suction device 119. The control of activating and terminating air flow of the suction device 119 is represented in FIG. 3 by the CPU 142 being connected to a suction operation unit 150, which represents a type of motor controller for initiating the activation or termination of the air flow by suction device 119 based upon a particular instruction received from CPU 142.

Further, the CPU 142 is connected to and controls air blowing unit 129. The memory 144 can be preprogrammed with appropriate delays based upon conveying speed of the first pre-conveyor 300 for example, and can be preprogrammed with control instructions for activating and terminating the pressure difference created by activating and terminating air flow of the suction device 119 for example. Additional control instructions for controlling various operations of inhibiting device 200, the suction device 119, the air blowing unit 129, and including preprogrammed delays or operations occurring based upon sensor input can also be prestored in memory 144.

Further illustrated in FIG. 3 are sensors 113 and 113*a* and proximity switch 114. Sensor 113 is preferably a photoelectric sensor as illustrated in FIG. 1, which is mounted on sensor mounting bracket 112, the sensor mounting bracket 112 being connected to fixed shaft 104. This photoelectric sensor 113 senses a leading edge of the workpiece 23 being conveyed on the first pre-conveyor 300, transfers the sensed information to CPU 142, which subsequently outputs a control signal to control the solenoid rotary actuators 229 and the fingers 229*a* thereof to inhibit conveying of the workpiece 23 on the first pre-conveyor 300 for example. In one aspect of the present application, the output of sensor 113 is sent to CPU 142 to control the fingers 229*a* of the solenoid rotary actuators 229 to inhibit the limp workpiece 23 a predetermined delay time after sensor 113 initially detects a leading edge of the workpiece 23. The predetermined delay time is stored in memory 144. One the delay has expired, an output control signal is sent from CPU 142 to solenoid actuators 229 to initiate the aforementioned control of the fingers 229*a* to inhibit the workpiece 23.

The operation of the photoelectric sensor 113 and the proximity switch 114 will be discussed as follows. The proximity switch 114 is placed in line with the photoelectric sensor 113. As the pre-conveyor 300 is constructed such that there are tables (of slats 322) and gaps, the photoelectronic sensor 113 is only activated when it senses a table. Initially, when the table arrives at the transfer mechanism 100, the proximity switch 114 senses the arrival. This is because slats 322 are preferably metal slats which, when sensed, trigger the proximity switch 114. The sensing signal from proximity switch 114 is then output to the controller 140. Receipt of such a signal then alerts controller 140 to check the status of the photoelectric sensor 113.

The photoelectric sensor 113 preferably operates as a retroreflective type of sensor. Reflective tape is preferably placed on the slats 322 of each table. If no limp workpiece 23 is on a table, then a reflection will be received from the reflective tape of a table of pre-conveyor 300 as the table passes by sensor 113, and the sensor will output an ON signal. However, if a limp workpiece 23 is on a table, no reflection will be received by sensor 113 and the sensor will output an OFF signal.

Once slats 322 of a table pass proximity switch 114, then a signal is output to controller 140. The controller 140 will then begin monitoring the output of the photoelectric sensor 113. When the photoelectric sensor 113 outputs an OFF signal to controller 140, it means that the limp workpiece 23 has arrived and thus the leading edge of the limp workpiece is sensed. It should be noted that the photoelectric sensor 113 will also attempt to output an OFF signal when it senses a gap, but since the proximity switch 114 is also off at this time, it does not affect the process since controller 140 has not been told to monitor signals from the photoelectric sensor 113.

Further, FIG. 3 illustrates sensor 113*a*, a sensor which is also connected to, and can send signals to, and receive signals from CPU 142. This sensor 113*a* can represent a sensor for detecting conveying of at least a leading edge of the limp workpiece 23 to a predetermined location (Z of FIG. 4*e* for example) and for outputting a signal indicative thereof to CPU 142 in the manner described previously regarding sensor 113, in conjunction with another proximity switch 114*a* (not shown) for example. This can be a predetermined location on the transfer mechanism 100 or it can be a predetermined location on the second post-conveyor 400. Further, this sensor 113*a* can be mounted on the transfer mechanism 100, or can alternatively be mounted on the second post-conveyor 400 and operates in a manner similar to photoelectric sensor 113.

Operation of the transfer mechanism 100 for transferring a limp workpiece 23 from a first pre-conveyor 300 to a second post-conveyor 400 will be described next with regard to FIGS. 4*a–h* and with regard to the flow chart of FIG. 5.

Figure 4A:
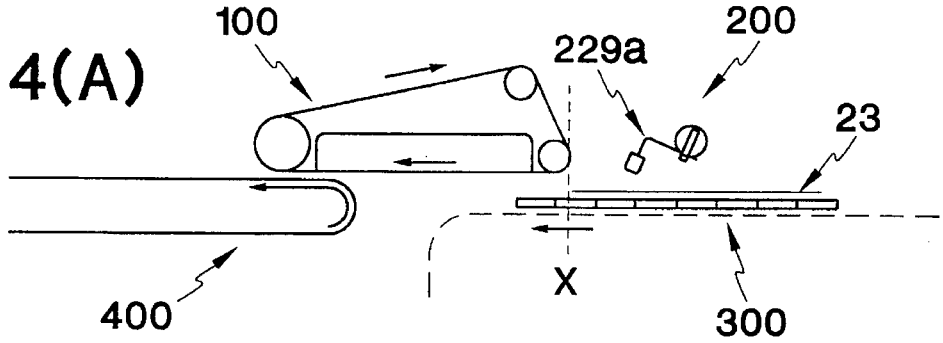
FIGS. 4*a*–4*h* are schematic illustrations of different stages of operation of the automatic suction type transfer apparatus of the present application transferring the limp workpiece from a first conveyor to a second conveyor.

As shown in FIG. 4*a*, the limp workpiece 23 is conveyed on the slats 322 of the first pre-conveyor 300 towards transfer mechanism 100. Preferably, the first pre-conveyor 300 and second post-conveyor 400 are operating or conveying at different speeds, with the transfer mechanism 100 operating at a speed similar to that of the second post-conveyor 400. However, this should not be considered limitive of the present application since operation can still occur quite successfully if the first pre-conveyor 300 and second post-conveyor 400 are operating at the same speeds.

The proximity switch 114 senses a table of slats 322 and the photoelectric sensor 113 then senses a leading edge of the limp workpiece 23. The sensor 113 then conveys this information to CPU 142 (in the manner described previously) of transfer mechanism 100. Then, since the CPU 142 of controller 140 has preferably been preprogrammed with a predetermined delay time stored in memory 144, the delay time being based upon a known speed of the first pre-conveyor 300 for example, the limp workpiece 23 is then conveyed a predetermined distance based upon the aforementioned delay after detection of the leading edge of the limp workpiece 23. More specifically, as shown in FIG. 4*a*, the limp workpiece 23 is initially sensed at point X as shown in FIG. 4*a* and as described in step S1 of FIG. 5 of the present application; and is conveyed for a predetermined time based on a known speed of the first pre-conveyor 300 as shown in step S3 of FIG. 5, to point Y as shown in FIG. 4*b*, based upon the aforementioned delay.

Alternatively, the leading edge of the limp workpiece 23 at position Y can be detected by a separate photoelectric sensor (not shown) similar to 113, which is separately mounted on the transfer mechanism 100 using a separate mounting bracket or mounted on any other stationary shaft (the separate photoelectric sensor looking through the transfer mechanism 100 on to the pre-conveyor 300). To do this, a tunnel is required in the transfer mechanism 100 so that the photoelectric sensor can look through the tunnel to the tables of pre-conveyor 300. With such a tunnel, there will be no loss of pressure as this can be a sealed tunnel. However, this is not preferable since sensor 113 can easily be mounted on bracket 112 in a front portion of the transfer mechanism 100.

Figure 4B:
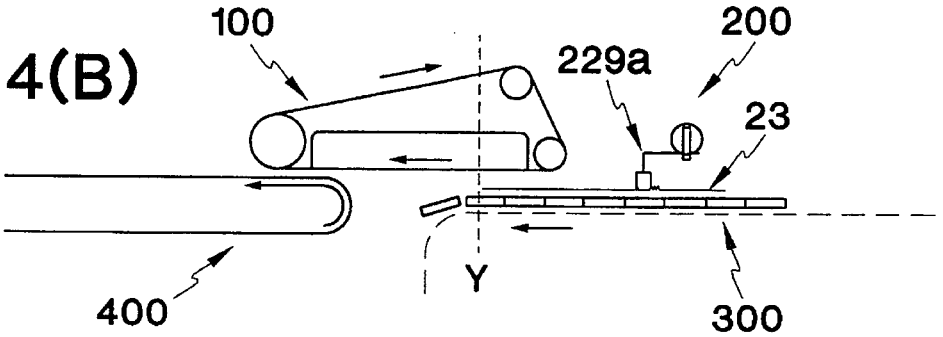

Upon reaching point Y as shown in FIG. 4*b*, the CPU 142 then outputs a control signal to activate solenoid rotary actuators 229. Once activated, the fingers 229*a* inhibit conveying of at least portion of the limp workpiece 23 including the leading edge thereof. As shown in FIG. 4*b*, the fingers 229*a* of the solenoid rotary actuators 229 clamp at least a portion of the workpiece 23 between fingers 229*a* of the solenoid rotary actuators 229 and the first pre-conveyor 300. This is achieved in step S5 as shown in FIG. 5.

As is further shown in FIG. 4*b*, a first portion of the workpiece including at least the leading edge is inhibited from being conveyed on the first pre-conveyor 300, but a second portion of the workpiece prior to the fingers 229*a* of solenoid rotary actuators 229 on the first pre-conveyor 300 is still being conveyed. Thus, the first pre-conveyor 300 is still moving while the fingers 229*a* of the solenoid rotary actuators 229 are holding down the limp material 23 so that in the first portion of the limp material 23, wrinkles present therein are removed and flattened, while in a trailing portion of the limp material 23 still being conveyed on the first pre-conveyor 300, extra wrinkles are created therein.

Next, in step S7, at least a leading portion of the limp workpiece 23 is transferred from the first pre-conveyor 300 to belt 118 of the transfer mechanism 100 via vacuum pressure from suction device 119. This occurs as follows.

Figure 4C:
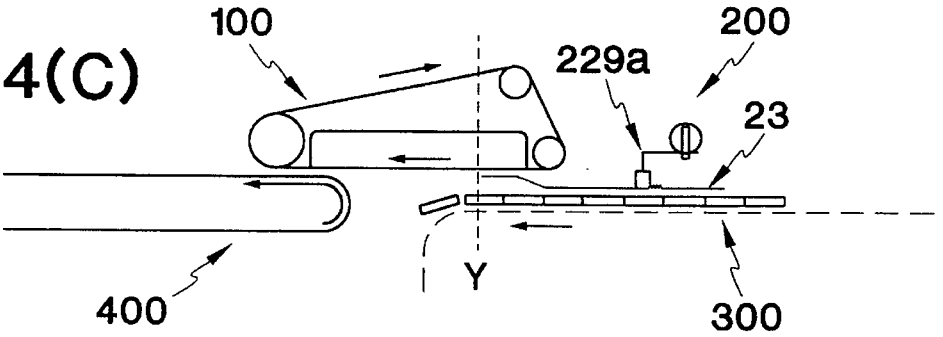

Subsequent to the solenoid rotary control actuators 229 being activated to enable fingers 229*a* to inhibit at least a portion of the limp workpiece 23 including the leading edge thereof, CPU 142 controls suction operation unit 150 to activate air flow in device 119. Activation of the air flow of suction device 119 creates a pressure difference which causes a portion of the limp workpiece 23 including the leading edge to be sucked up from the first pre-conveyor 300 against the belts 118 of the transfer mechanism 100. This occurs due to the fact that when suction device 119, preferably an air flow amplifier, amplifies the air flow, a low pressure region is generated in the suction chamber 106. The surrounding air on top of the limp workpiece 23 starts flowing into the suction chamber 106 through the belts 118 (with aerated holes therein) and the through-slots 127. This in turn creates a pressure difference in the surrounding of the workpiece 23 which lifts the workpiece 23 to the transfer mechanism 100. A trailing portion of the workpiece 23, at this time, is still held by the fingers 229*a* of solenoid rotary actuators 229 as is shown in FIG. 4*c*.

Figure 5:
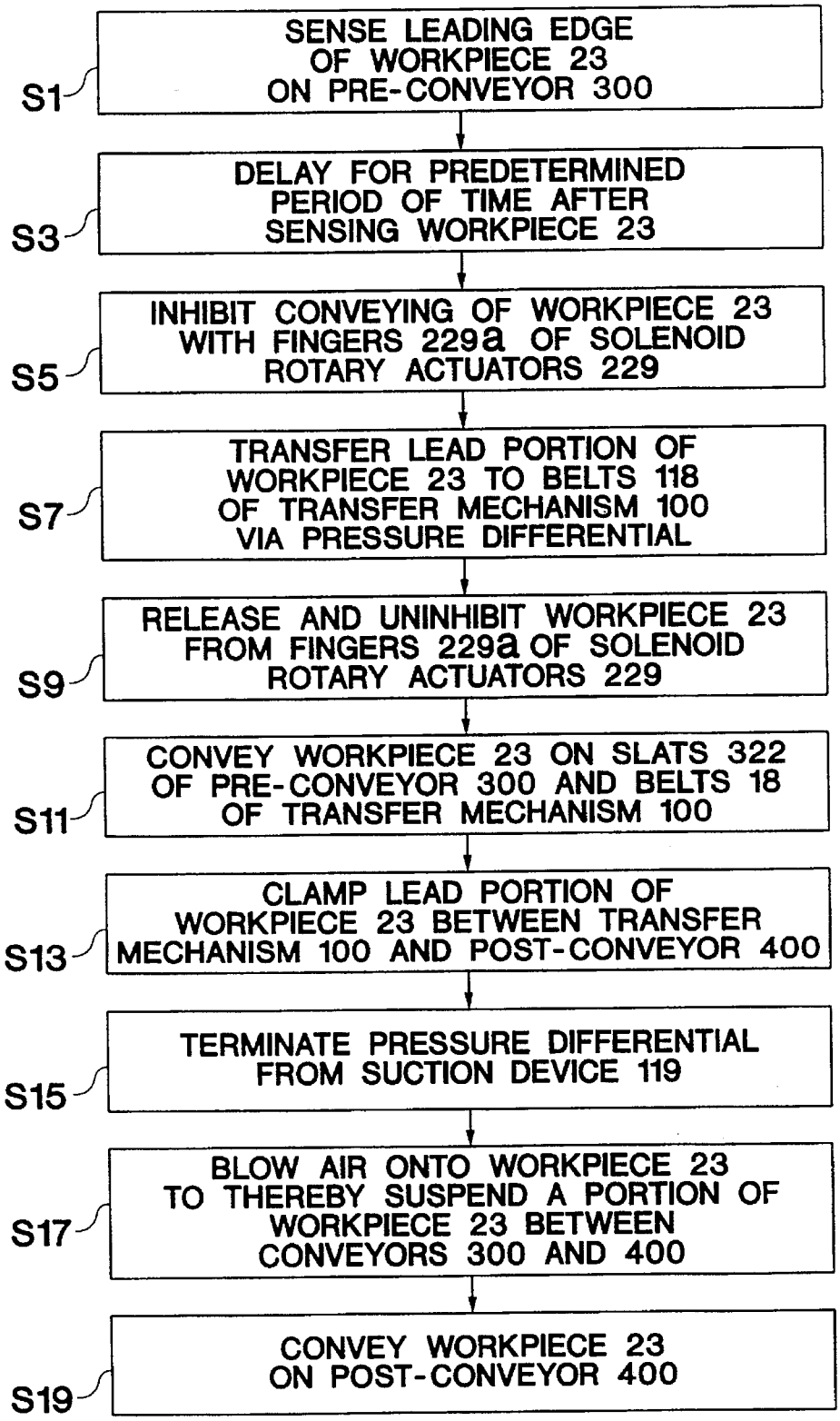
FIG. 5 is a flow chart illustrating the operation of the automatic suction type transfer apparatus of the present application.

Next, in step S9 as shown in FIG. 5, CPU 142 sends a signal to solenoid rotary actuators 229 to uninhibit the workpiece 23 by releasing it from the fingers 229*a* of the solenoid rotary actuators 229. Output of this control signal from CPU 142 to solenoid rotary actuators 229 occurs after the suction device 119 has been activated to generate air flow and create a pressure difference. It should be noted that the controller 140 activates/deactivates a solenoid air valve to create air flow by letting the compressed air flow in/out through the suction device 119.

Figure 4D:
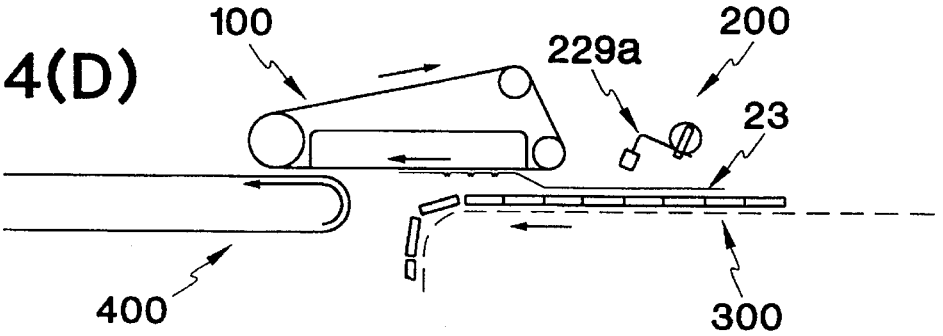

Thus, the leading edge of the workpiece 23 has been transferred to belts 118 of transfer mechanism 100, subsequent to the CPU 142 outputting a signal to control the fingers 229*a* of solenoid rotary actuators 229 to release and uninhibit conveying of the limp workpiece 23 on the first pre-conveyor 300. As shown in FIG. 4*d*, the fingers 229*a* of solenoid rotary actuators 229 have released the limp workpiece 23. Once the limp workpiece 23 has been released from the fingers 229*a* of solenoid rotary actuators 229, the trailing portion of the workpiece 23 is conveyed by the first pre-conveyor 300 and the leading portion of the workpiece is conveyed by transfer mechanism 100.

The control of the release/uninhibit of the limp workpiece 23 is done based on the predetermined time delay. Although the time delay may vary for pre-conveyors of different speeds, it is always fixed based upon a known speed of the pre-conveyor 300. It is easy to determine this delay as the limp workpiece 23 gets sucked up as soon as the suction device 119 is activated. An alternate method is to use another capacitive proximity switch (such as proximity switch 114) embedded in the bottom of the base plate 124. This other proximity switch senses when the limp workpiece 23 gets lifted up and sends the signal indicating this to the controller 142, which in turn controls the solenoid actuators 229 for releasing/uninhibiting of the limp workpiece 23 by fingers 229*a*.

Alternatively, when the limp workpiece 23 is transported under transfer mechanism 100, the transfer mechanism 100 sucks the leading edge of the limp workpiece 23 against belts 118. The solenoid fingers 229*a* then hold the remainder of the limp workpiece 23 in order to get rid of wrinkles. The wrinkles disappear as the running belts 118 of the transfer mechanism 100 tend to flatten the stationary limp workpiece 23. The limp workpiece 23 can then be released.

Since transfer mechanism 100 and the first pre-conveyor 300 preferably operate at different speeds, with the first pre-conveyor even more preferably operating at a speed faster than that of the transfer mechanism, wrinkles are created in the limp workpiece 23 as is shown in FIG. 4*d*. However, since a first portion of the limp workpiece including the leading edge was transferred to the belts 118 of the transfer mechanism 100 prior to the release of the fingers 229*a* of solenoid rotary actuators 229, the aforementioned wrinkles in the limp workpiece are formed only in a trailing portion of the workpiece 23. Thus, a portion of the limp workpiece 23 including the leading edge has no wrinkles created therein. Conveying of the workpiece 23 on the slats 322 of the first pre-conveyor 300 and on the belts 118 of the transfer mechanism 100 is described in step S11 of FIG. 5.

Figure 4E:
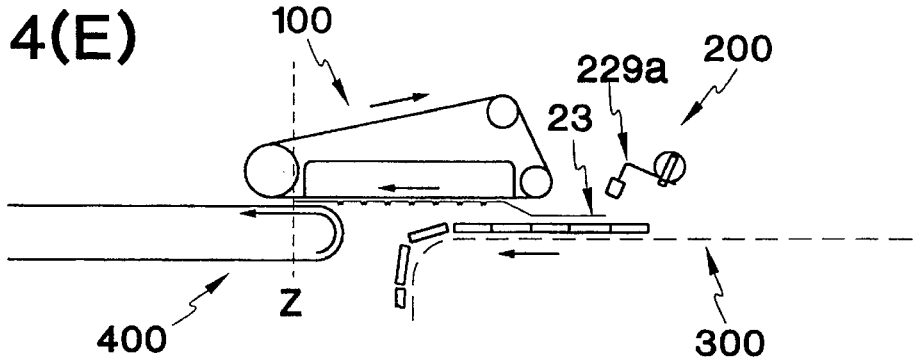

As shown in FIG. 4*e*, a leading edge of the workpiece 23 is conveyed on transfer mechanism 100 until it reaches a predetermined location Z, a location in which the limp workpiece 23 is actually sandwiched or clamped between and traveling on both the belts 118 of transfer mechanism 100 and the belts 420 of the second post-conveyor 400. The CPU 142 of controller 140 can determine that the limp workpiece 23 has been conveyed to point Z as shown in FIG. 4*e* by any number of ways, some of which will be explained hereafter.

The CPU 142 is preferably preprogrammed in memory 144 with a predetermined delay time period. This predetermined delay time period corresponds to the time which it takes for the leading edge of the workpiece 23 to travel from point Y (known) of FIG. 4*c* to point Z (known) of FIG. 4*e*, with the conveying speed of transfer mechanism 100 also being known.

Alternatively, the CPU 142, through a sensor 113*a*, can detect that a leading edge of the limp workpiece 23 has reached point Z as shown in FIG. 4*e*, wherein the leading edge of the limp workpiece 23 is clamped between and conveyed on both transfer mechanism 100 and the second post-conveyer 400. Such a sensor 113*a* is mounted on the transfer mechanism 100 and can detect that the leading edge of the workpiece 23 reaches a predetermined location, point Z of FIG. 4*e*, on the transfer mechanism 100. Alternatively, the sensor 113*a* can detect that the leading edge of the limp workpiece 23 has reached a predetermined location Z on the second post-conveyor 400. Still further, the sensor 113*a* can alternatively be mounted on the second post-conveyor 400 to detect that the limp workpiece has reached a predetermined location Z either on the transfer mechanism 100 or on the second post-conveyor 400.

Figure 4F:
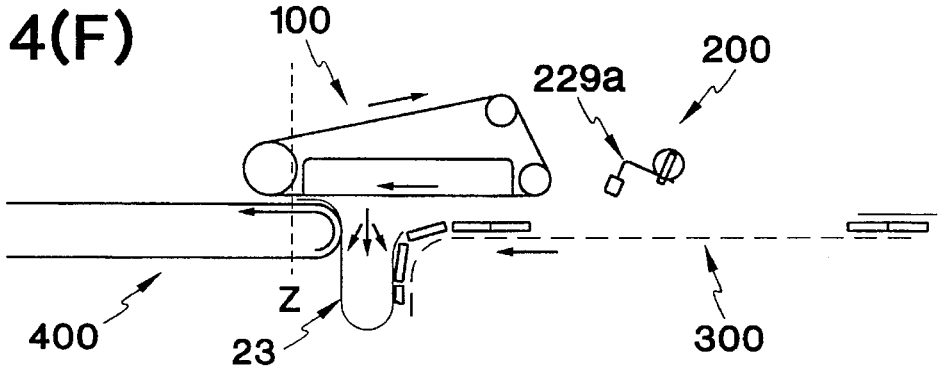

Sensor 113*a* can either be mounted on the transfer mechanism 100 or post-conveyer 400. Mounting of this sensor 113*a* on either place is not significant. This sensor 113*a* is similar to sensor 113 and can further be mounted on top plate 106 of the transfer mechanism 100 looking down on the conveyor 400 at a piece of reflective tape. When the limp workpiece 23 comes out and underneath from the transfer mechanism 100, its leading edge will interrupt the sensor 113*a*, and thus will be sensed and therefore it will be indicated to CPU 142 that the leading portion of workpiece 23 has been clamped. mechanism 100 and the second post-conveyor 400 takes place in step S13. Thereafter, in step S15, operation of the air flow amplifier or suction device 119 is terminated, i.e. it is shut off. This also terminates air flow and the previously created pressure differential. Then, in step S17, compressed air is blown out by air blowing unit 129 through air outlets 128 which push the limp workpiece 23 downward. This is shown in FIG. 4*f*. By the air blow unit 129 blowing compressed air through air outlets 128, after a middle portion of the limp workpiece 23 drops between both pre-conveyor 300 and post-conveyor 400, the trailing portion of the limp workpiece 23 falls between the pre-conveyor 300 and the post-conveyor 400, and wrinkles are thus removed from the limp workpiece 23.

Figure 4G:
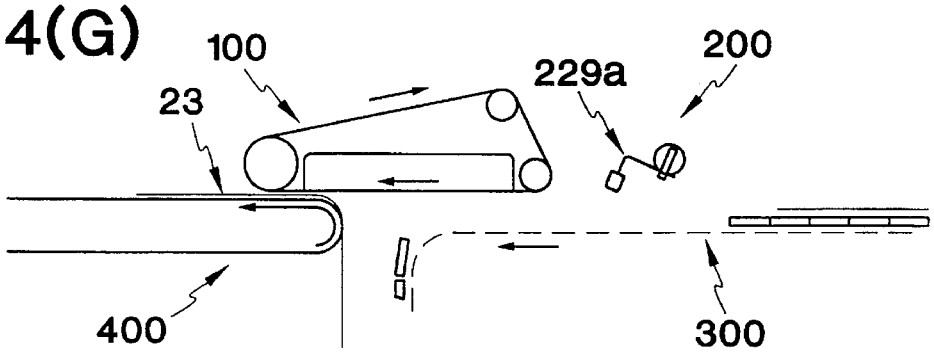

More specifically, due to this termination of the created pressure differential (by terminating air flow by the suction device 119) and blowing of compressed air through air outlets 128, a middle portion of the limp workpiece 23 hangs down as shown in FIG. 4*f*, and eventually a trailing portion including a trailing edge of the limp workpiece 23 is conveyed off the first pre-conveyor 300. This is shown in FIG. 4*g*. Still further, as is shown in FIG. 4*f*, although a middle portion of the limp workpiece 23 falls and a trailing portion is blown downward between the first preconveyer 300 and the second post-conveyor 400, a first portion of the limp workpiece 23 including at least the leading edge remains clamped between and conveyed on both the transfer mechanism 100 and the second post-conveyor 400. The blowing of compressed air onto the workpiece 23 through air outlets 128 is described as step S17 of FIG. 5.

By the termination of the operation of the suction device 119, the pressure difference is removed. Further, by blowing compressed air onto a middle portion of the workpiece 23, after clamping a lead portion of the limp workpiece 23 between the transfer mechanism 100 and the second post-conveyor 400, the previously generated wrinkles as shown in FIGS. 4*d* and 4*e* are removed as shown in FIG. 4*g*. Since wrinkles from at least a leading portion of the limp workpiece 23 were removed upon clamping of the limp workpiece 23 between fingers 229*a* of the solenoid rotary actuators 229 and the first pre-conveyor 300; since no further wrinkles were created in this first portion of the limp workpiece 23 including the leading edge upon uninhibiting the workpiece by releasing the fingers 229*a* of the solenoid rotary actuators 229 (created in only the trailing portion of the limp workpiece 23 as shown in FIG. 4*d*); and since this unwrinkled leading edge of the workpiece 23 was clamped between the transfer mechanism and the second post-conveyor 400 prior to terminating air flow from suction device 119 in step S15 and blowing compressed air onto the limp workpiece 23 in step S17, a limp workpiece 23 is eventually transferred and conveyed on the second post-conveyor, this limp workpiece 23 having wrinkles removed therefrom.

Figure 4H:
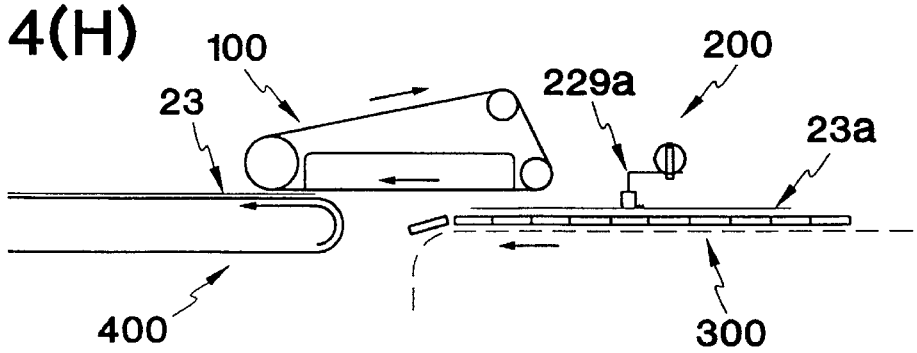

As shown in FIG. 4*g*, the trailing portion of the workpiece 23 flattens itself and removes wrinkles therefrom as it hangs down between the first pre-conveyor 300 and the second post-conveyor 400, resulting in a flat workpiece being conveyed on the second post-conveyor 400, with wrinkles normally caused when transferring a workpiece via vacuum pressure removed therefrom. As shown in FIG. 4*h*, the first workpiece 23 is conveyed on the second post-conveyor 400 in step S19, and a next workpiece 23*a* is detected on a next table and is inhibited by fingers 229*a* of solenoid rotary actuators 229. Thus, a limp workpiece 23 is transferred between a first pre-conveyor 300 preferably moving at a relatively slower speed, to a second post-conveyor 400 preferably moving at a relatively faster speed, via transfer mechanism 100 utilizing air flow to create a pressure differential, with the limp workpiece 23 conveying on the second post-conveyor 400 without unnecessary wrinkles present therein.

It should be clear that the transfer mechanism and method of the present application can be varied in many ways. For instance, the sensor 113 can detect a leading edge of the workpiece and based upon a predetermined delay programmed therein, the fingers 229*a* of solenoid rotary actuators 229 can thereafter inhibit at least a portion of the limp workpiece 23 a predetermined time thereafter. Subsequently, based upon another preprogrammed predetermined time, the fingers 229*a* of solenoid rotary actuators 229 can thereafter uninhibit the limp workpiece 23. The predetermined time merely provides a brief time period in which air flow can be activated in suction device 119 to create a pressure differential to transfer a leading portion of the workpiece 23 to belts 118 of transfer mechanism 100.

Further, an additional sensor can be included to detect that the leading edge of the workpiece reaches point Y of FIGS. 4*b* and 4*c*, this point being a point below suction device 119 such that the limp workpiece 23 is below approximately one third of the suction device 119, for example. The aforementioned detection would then trigger activation of air flow in the suction device 119 to transfer a leading portion of the limp workpiece 23 to belts 118 of the transfer mechanism 100 via the pressure differential.

Still further, the orientation of the limp workpiece 23 never changes during the conveying process. Orientation is maintained when the suction device 119 sucks the limp workpiece 23, to lift it up and from the first pre-conveyor 300, while the fingers 229*a* of solenoid rotary actuators 229 are still holding it. Therefore the orientation of the limp workpiece 23 before getting lifted up, remains the same as it is after being lifted up. Similarly, when the limp workpiece 23 is being transferred to the post-conveyer 400, a given length of the limp workpiece 23 is sandwiched between the transfer mechanism conveying belts 118 and post-conveyor 400 before the rest of the limp workpiece 23 is allowed to fall straight down between the pre-conveyor 300 and post-conveyor 400. This again maintains the orientation of the limp workpiece 23. Hence, the orientation of the limp workpiece 23 when it is laid on the pre-conveyor 300 remains the same as it is when transferred to and laid on the post-conveyor 400. Finally, it should be noted that for a given set of apparatus, the suction device 119 (device which amplifies air flow) is sized big enough to be able to handle different/varying weights of a limp workpiece 23.

Also, the surface speed of the transfer mechanism 100 and next post-conveyor 400 is easily synchronized. This is achieved by gearing the driven shaft of the post-conveyor 400 to the driving shaft of the transfer mechanism 100.

Even further, it should be noted that the transfer mechanism 100 can be designed to transfer different sizes of limp workpieces 23. For the smallest size of workpiece 23, the only constraint is that the limp workpiece 23 should be long enough to be sucked by the suction device 119, and be held by the fingers 229*a* of the solenoid rotary actuators 229 at the same time. Any other size bigger than the smallest in length can be handled without any problem. The width of the limp workpiece 23 is limited to the width of the conveying apparatuses. Also, within a reasonable size range, almost any shape can be transferred as the suction device 119 sucks a portion of the limp workpiece 23 and the same portion is sandwiched between the transfer mechanism belts 118 and the belts 420 of post-conveyor 400.

Finally, it should be noted that instead of using a PLC 140 with preprogrammed delay times, separate relays could be used to detect the leading edge of the workpiece 23; to trigger activation of the air flow amplifiers, inhibition of the workpiece, uninhibition of the workpiece; to detect the workpiece being clamped; to trigger deactivation of the air flow amplifier, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of transferring a limp workpiece from a first conveyor to a second conveyor, comprising the steps of:

(a) sensing a leading edge of the limp workpiece traveling on the first conveyor;

(b) creating a pressure differential to transfer the sensed leading edge of the limp workpiece from the first conveyor to a transfer mechanism;

(c) conveying, on the transfer mechanism, the leading edge of the limp workpiece to the second conveyor;

(d) terminating the pressure differential created in step (b), subsequent to step (c), to drop a middle portion of the limp workpiece excluding at least the leading edge, between the first and second conveyors to remove wrinkles from the limp workpiece; and (e) conveying the limp workpiece on the second conveyor.

2. The method of claim 1, further comprising the steps of:

(f) inhibiting travel of the limp workpiece on the first conveyor subsequent to the sensing of step (a); and (g) uninhibiting travel of the limp workpiece on the first conveyor subsequent to the supplying of step (b).

3. The method of claim 2, wherein travel of a first portion of the limp workpiece, including the leading edge, is inhibited in step (f), to remove wrinkles from the first portion of the limp workpiece.

4. The method of claim 3, wherein the first conveyor and the transfer mechanism convey the limp workpiece at different speeds.

5. The method of claim 4, wherein the conveying of the limp workpiece at different speeds creates wrinkles in the middle portion of the limp workpiece, the wrinkles being removed in step (d).

6. The method of claim 2, wherein travel is inhibited in step (f), a predetermined time after sensing the leading edge in step (a).

7. The method of claim 6, wherein the time is predetermined based upon a conveying speed of the first conveyor.

8. The method of claim 7, wherein the time is further predetermined based upon a relative location of a suction device, for supplying air flow to create the pressure differential in step (b), in the transfer mechanism, such that the limp workpiece is positioned below a predetermined portion of the suction device.

9. The method of claim 2, wherein travel is uninhibited in step (g) a predetermined time after creating a pressure differential in step (b).

10. The method of claim 1, wherein the first conveyor and the transfer mechanism convey at different speeds.

11. The method of claim 10, wherein the first conveyor conveys at a speed slower than a conveying speed of the transfer mechanism, thereby creating wrinkles in the middle portion of the limp workpiece during conveying in step (c).

12. The method of claim 1, wherein the first conveyor and the second conveyor convey at different speeds.

13. The method of claim 12, wherein the second conveyor and the transfer mechanism convey at equal speeds.

14. The method of claim 1, wherein air flow is supplied in step (b) to create the pressure differential and air flow is terminated in step (d) to terminate the pressure differential.

15. The method of claim 14, further comprising the step of:

(f) detecting that at least the leading edge of the limp workpiece has been conveyed to at least a predetermined location and terminating the air flow in step (d) subsequent to the detecting of step (f).

16. The method of claim 15, wherein step (d) includes the substeps of, (d1) terminating the air flow subsequent to the detecting of step (f), and (d2) blowing air onto the middle portion of the limp workpiece to drop the middle portion and a trailing portion of the limp workpiece between the first and second conveyors to remove wrinkles from the limp workpiece, subsequent to the terminating of step (d1).

17. The method of claim 1 wherein the terminating of the pressure differential in step (d) occurs a predetermined time after conveying the leading edge of the workpiece to the second conveyor.

18. The method of claim 17, wherein at least the leading edge of the limp workpiece is clamped between, and is traveling on, both the transfer mechanism and the second conveyor prior to the terminating of step (d).

19. The method of claim 14, wherein step (d) includes the substeps of:

(d1) detecting that the leading edge of the workpiece is traveling on the second conveyor;

(d2) terminating the air flow a predetermined time after detecting in step (d1).

20. The method of claim 19, wherein step (d) further includes the substep of:

(d3) blowing air onto the middle portion of the limp workpiece to drop the middle portion and a trailing portion of the limp workpiece between the first and second conveyors to remove wrinkles from the limp workpiece, subsequent to the terminating of step (d2).

21. The method of claim 20, wherein at least a trailing edge of the limp workpiece is traveling on the first conveyor prior to the air blowing of step (d3).

22. The method of claim 19, wherein step (d1) occurs subsequent to at least the leading edge of the limp workpiece being clamped between, and traveling on, both the transfer mechanism and the second conveyor.

23. A method of transferring a limp workpiece from a first conveyor traveling at a first speed, to a second conveyor traveling at a second speed different from the first speed, comprising the steps of:

(a) sensing a leading edge of the limp workpiece traveling on the first conveyor at the first speed;

(b) creating a pressure differential to transfer the sensed leading edge of the limp workpiece from the first conveyor to a transfer mechanism, traveling at the second speed;

(c) conveying, on the transfer mechanism, at least the leading edge of the limp workpiece to the second conveyor;

(d) conveying at least the leading edge on, and clamping at least the leading edge between, both the transfer mechanism and the second conveyor, both traveling at the second speed; and (e) terminating the pressure differential created of step (b) subsequent to the conveying and clamping of step (d).

24. The method of claim 23, further comprising the steps of:

(f) inhibiting travel of the limp workpiece on the first conveyor subsequent to the sensing of step (a); and (g) uninhibiting travel of the limp workpiece on the first conveyor subsequent to the activating of step (b).

25. The method of claim 24, wherein travel of a first portion of the limp workpiece, including the leading edge, is inhibited in step (f), to remove wrinkles from the first portion of the limp workpiece.

26. The method of claim 24, wherein travel is inhibited in step (f), a predetermined time after sensing the leading edge in step (a).

27. The method of claim 26, wherein the time is predetermined based upon a conveying speed of the first conveyor.

28. The method of claim 27, wherein the time is further predetermined based upon a relative location of a suction device, for supplying air flow to create the pressure differential in step (b), in the transfer mechanism, such that the limp workpiece is positioned below a predetermined portion of the suction device.

29. The method of claim 24, wherein travel is uninhibited in step (g) a predetermined time after creating the pressure differential in step (b).

30. The method of claim 23, wherein the pressure differential is terminated in step (e) to drop a middle portion of the limp workpiece, excluding at least the leading edge, between the first and second conveyor to remove wrinkles from the limp workpiece.

31. The method of claim 30, wherein the conveying of the limp workpiece at different speeds creates wrinkles in the middle portion of the limp workpiece, the wrinkles being removed in step (e).

32. The method of claim 23, wherein the first conveyor conveys at a speed slower than a conveying speed of the transfer mechanism, thereby creating wrinkles in the middle portion of the limp workpiece during conveying in step (c).

33. The method of claim 23, wherein air flow is supplied in step (b) to create the pressure differential and air flow is terminated in step (d) to terminate the pressure differential.

34. The method of claim 33, wherein step (e) includes the substeps of:

(e1) detecting that the leading edge of the workpiece is conveying on the second conveyor;

(e2) terminating the air flow a predetermined time after detecting in step (e1).

35. The method of claim 34, wherein step (e) further includes the substep of:

(e3) blowing air onto the middle portion of the limp workpiece to drop the middle portion and a trailing portion of the limp workpiece between the first and second conveyors to remove wrinkles from the limp workpiece, subsequent to the terminating of step (e2).

36. The method of claim 23 wherein the terminating of the pressure differential in step (e) occurs a predetermined time after conveying the leading edge of the workpiece to the second conveyor.

37. The method of claim 35, wherein at least a trailing edge of the limp workpiece is traveling on the first conveyor prior to blowing air in step (e3).

38. The method of claim 34 wherein step (e1) occurs subsequent to at least the leading edge of the limp workpiece being clamped between, and traveling on, both the transfer mechanism and the second conveyor in step (d).

39. The method of claim 33, further comprising the step of:

(f) detecting that at least the leading edge of the limp workpiece has been conveyed to at least a predetermined location and terminating the air flow in step (e) subsequent to the detecting of step (f).

40. The method of claim 39, wherein step (e) includes the substeps of, (e1) terminating the air flow subsequent to the detecting of step (f), and (e2) blowing air onto the middle portion of the limp workpiece to drop the middle portion and a trailing portion of the limp workpiece between the first and second conveyors to remove wrinkles from the limp workpiece, subsequent to the terminating of step (e1).

41. A transfer apparatus for transferring a limp workpiece from a first conveyor to a second conveyor, comprising:

first means for sensing a leading edge of the limp workpiece traveling on the first conveyor;

second means for creating a pressure differential to transfer the sensed leading edge of the limp workpiece from the first conveyor to the transfer apparatus;

third means for conveying the leading edge of the limp workpiece to the second conveyor, the second means terminating the pressure differential supplied subsequent to the third means conveying the leading edge to the second conveyor, to drop a middle portion of the limp workpiece excluding at least the leading edge, between the first and second conveyors to remove wrinkles from the limp workpiece, thereafter conveyed on the second conveyor.

42. The apparatus of claim 41, further comprising:

control means for creating a delay between a time when the leading edge of the limp workpiece is sensed by the first means and a time when travel of the limp workpiece on the first conveyor is inhibited.

43. The apparatus of claim 42, wherein the control means further controls uninhibiting of travel of the limp workpiece on the first conveyor, subsequent to the second means creating the pressure differential.

44. The apparatus of claim 42, wherein travel is inhibited a predetermined delay time after the first means senses the leading edge of the limp workpiece.

45. The apparatus of claim 44, wherein the delay time is predetermined by the control means based upon a conveying speed of the first conveyor.

46. The apparatus of claim 45, wherein the delay time is further predetermined by the control means based upon a relative location of the second means in the transfer apparatus, such that the limp workpiece is positioned below a predetermined portion of the second means.

47. The apparatus of claim 41, wherein the third means conveys at a speed different from the first conveyor.

48. The apparatus of claim 47, wherein the conveying of the limp workpiece by the third means, at a speed different from the first conveyor, creates wrinkles in the middle portion of the limp workpiece, the wrinkles being removed by dropping the middle portion.

49. The apparatus of claim 41, wherein the transfer apparatus transfers the limp workpiece between the first conveyor conveying at a first speed and the second conveyor conveying at a second speed, different from the first speed.

50. The apparatus of claim 49, wherein the second conveyor and the third means convey at equal speeds.

51. The apparatus of claim 50, wherein the first conveyor conveys at a speed slower than the third means, thereby creating wrinkles in the middle portion of the limp workpiece during conveying by the third means.

52. The apparatus of claim 50, wherein at least the leading edge of the limp workpiece is clamped between, and is traveling on, both the third means and the second conveyor prior to the terminating by the second means.

53. The apparatus of claim 41, wherein the terminating of the pressure differential by the second means occurs a predetermined time after the third means conveys the leading edge of the workpiece to the second conveyor.

54. The apparatus of claim 41, further comprising:

fourth means for detecting that the leading edge of the workpiece is traveling on the second conveyor, wherein the second means supplies air flow to create the pressure differential and terminates the air flow to terminate the pressure differential, the second means terminating the air flow a predetermined time after detecting by the fourth means.

55. The apparatus of claim 54, wherein the second means further blows air onto the middle portion of the limp workpiece to drop the middle portion and a trailing portion of the limp workpiece between the first and second conveyors to remove wrinkles from the limp workpiece, after terminating the supplied air flow.

56. The apparatus of claim 41, further comprising:

fourth means for detecting that at least the leading edge of the limp workpiece has been conveyed to at least a predetermined location, wherein the second means supplies air flow to create the pressure differential and terminates the air flow to terminate the pressure differential, the second means terminating the air flow subsequent to the detecting by the fourth means.

57. The apparatus of claim 56, wherein the second means further blows air onto the middle portion of the limp workpiece to drop the middle portion and a trailing portion of the limp workpiece between the first and second conveyors to remove wrinkles from the limp workpiece, subsequent to terminating the supplied air flow.

58. A transfer apparatus for transferring a limp workpiece from a first conveyor to a second conveyor, comprising:

first means for sensing a leading edge of the limp workpiece traveling on the first conveyor;

second means for creating a pressure differential to transfer the sensed leading edge of the limp workpiece from the first conveyor to the transfer apparatus;

third means for conveying the leading edge of the limp workpiece to the second conveyor, the second means terminating the created pressure differential subsequent to the third means conveying the leading edge to the second conveyor, to drop a middle portion of the limp workpiece excluding at least the leading edge, between the first and second conveyor to remove wrinkles from the limp workpiece, thereafter conveyed on the second conveyor.

59. The apparatus of claim 58, further comprising:

control means for creating a delay between a time when the leading edge of the limp workpiece sensed by the first means and a time when travel of the limp workpiece on the first conveyor is inhibited.

60. The apparatus of claim 59, wherein the control means further controls uninhibiting of travel of the limp workpiece on the first conveyor, subsequent to the second means creating the pressure differential.

61. The apparatus of claim 58, wherein the conveying of the limp workpiece at different speeds creates wrinkles in the middle portion of the limp workpiece, the wrinkles being removed by the second means.

62. The apparatus of claim 58, wherein the first conveyor conveys at a speed slower than a conveying speed of the third means, thereby creating wrinkles in the middle portion of the limp workpiece during conveying by the third means.

63. The apparatus of claim 58, wherein travel is inhibited, a predetermined delay time after the first means senses the leading edge of the limp workpiece.

64. The apparatus of claim 63, wherein the delay time is predetermined by the control means based upon a conveying speed of the first conveyor.

65. The apparatus of claim 64, wherein the delay time is further predetermined by the control means based upon a relative location of the second means in the transfer apparatus, such that the limp workpiece is positioned below a predetermined portion of the second means.

66. The apparatus of claim 58, wherein the pressure differential is terminated by the second means, subsequent to the third means conveying the leading edge to the second conveyor and the clamping of at least the leading edge of the limp workpiece between the third means and the second conveyor.

67. The apparatus of claim 58, wherein the terminating of the pressure differential by the second means occurs a predetermined time after the third means conveys the leading edge of the workpiece to the second conveyor.

68. The apparatus of claim 58, further comprising:

fourth means for detecting that the leading edge of the workpiece is clamped between and conveying on both the third means and the second conveyor, wherein the second means supplies air flow to create the pressure differential and terminates the air flow to terminate the pressure differential, the second means terminating the air flow a predetermined time after detecting by the fourth means.

69. The apparatus of claim 68, wherein the second means further blows air onto the middle portion of the limp workpiece to drop the middle portion and a trailing portion of the limp workpiece between the first and second conveyors to remove wrinkles from the limp workpiece, after terminating the air flow.

70. The apparatus of claim 58, further comprising:

fourth means for detecting that at least the leading edge of the limp workpiece has been conveyed to at least a predetermined location, wherein the second means supplies air flow to create the pressure differential and terminates the air flow to terminate the pressure differential, the second means terminating the air flow subsequent to the detecting by the fourth means.

71. The apparatus of claim 70, wherein the second means terminates the air flow subsequent to the detecting by the fourth means, the second means further blows air onto the middle portion of the limp workpiece to drop the middle portion and a trailing portion of the limp workpiece between the first and second conveyors to remove wrinkles from the limp workpiece, subsequent to terminating the supplied air flow.

* * * * *